US007847766B2

(12) United States Patent
Watanabe et al.

(10) Patent No.: US 7,847,766 B2
(45) Date of Patent: Dec. 7, 2010

(54) SELF-EMISSION DISPLAY APPARATUS AND METHOD OF DRIVING THE SAME

(75) Inventors: Teruichi Watanabe, Yamagata (JP); Takayoshi Yoshida, Yamagata (JP)

(73) Assignee: Tohoku Pioneer Corporation, Yamagata (JP)

( * ) Notice: Subject to any disclaimer, the term of this patent is extended or adjusted under 35 U.S.C. 154(b) by 1042 days.

(21) Appl. No.: 11/483,563

(22) Filed: Jul. 11, 2006

(65) Prior Publication Data

US 2007/0013619 A1 Jan. 18, 2007

(30) Foreign Application Priority Data

Jul. 12, 2005 (JP) ..... 2005-202963

(51) Int. Cl.
*G09G 3/32* (2006.01)

(52) U.S. Cl. ..... 345/82; 345/77; 345/83

(58) Field of Classification Search ..... 345/76–83
See application file for complete search history.

(56) References Cited

U.S. PATENT DOCUMENTS

2004/0263445 A1* 12/2004 Inukai et al. ..... 345/82
2005/0156831 A1* 7/2005 Yamazaki et al. ..... 345/76

FOREIGN PATENT DOCUMENTS

JP 2001-223074 8/2001
JP 2002-304155 10/2002

* cited by examiner

*Primary Examiner*—Alexander Eisen
*Assistant Examiner*—Stuart McCommas
(74) *Attorney, Agent, or Firm*—Arent Fox LLP

(57) ABSTRACT

It is an object of the present invention to inhibit a collapse of a color balance possibly caused due to deterioration of self-emission elements when performing a color displaying by virtue of several different colors. A self-emission display apparatus comprises: a display element section consisting of self-emission elements; a monitor element section consisting of self-emission elements of different colors formed in the same manner as the self-emission elements of the display element section; a power supply circuit which supplies driving voltages to the display element section; monitor detecting units for detecting an operating state of the monitor element section; driving voltage control units which control driving voltages in accordance with a detected operating state; and a display control section for supplying display signal to the display element section. Further, the self-emission display apparatus has monitor control units which perform lighting controls of the foregoing different colors on the monitor element section, as well as a monitor load adjusting unit which adjusts a load state of each of the foregoing different colors in lighting control so as to maintain a color balance of the display element section.

3 Claims, 6 Drawing Sheets

SELF-EMISSION DISPLAY APPARATUS AND METHOD OF DRIVING THE SAME

BACKGROUND OF THE INVENTION

The present invention relates to a self-emission display apparatus and a method of driving the same.

The present application claims priority from Japanese Application No. 2005-202963, the disclosure of which is incorporated herein by reference.

A self-emission display apparatus equipped with self-emission elements such as organic EL elements (acting as essential elements) has been used as an information displaying device, and an illuminating light source such as a general illumination, a back light or one of other kinds of light sources, and has been expected for use as a new type of display device such as a paper display.

Each of self-emission elements acting as essential elements for a self-emission display apparatus has a basic structure formed by interposing a semiconductor layer having p-n junction between an anode (or hole injection electrode) and a cathode (or electron injection electrode). If a self-emission element is a low molecule type organic EL element, the semiconductor layer will being laminated structure comprising organic layers including a luminescent layer. On the other hand, if a self-emission element is a high molecule type organic EL element, the semiconductor layer will be comprised of organic layers providing a laminated structure formed by laminating one or more bipolar material layers. In this way, when a voltage is applied between the two electrodes which are the anode and the cathode, positive holes injected and transported from the anode into the organic layers and electrodes injected and transported from the cathode into the organic layers will be recombined with each other within an organic layer (for example, luminescent layer), thereby producing an energy from an excited state formed due to the recombination, thus effecting an emission of light.

FIG. 1A is a graph showing a current-voltage characteristic of an organic EL element. According to such a characteristic, when a driving voltage (a voltage in a forward direction) larger than an emission threshold voltage V this applied to the organic EL element, it is possible to obtain an emission brightness L proportional to an electric current corresponding to the driving voltage. On the other hand, if an applied driving voltage is equal to or lower than the emission threshold voltage Vth, there will be no driving current and an emission brightness will stay at a value equal to zero.

Thus, with regard to a self-emission element capable of providing an emission brightness proportional to an electric current, it is easy to set a desired brightness by performing a constant-current driving. However, a constant-current driving is usually associated with a complex peripheral circuit.

Accordingly, with respect to a self-emission element such as an organic EL element having a current-brightness characteristic, an often used driving method usually employs a constant-voltage driving device which is cheap and easily available. During such a constant-voltage driving, as shown in FIG. 1A, a self-emission element such as an organic EL element will change in its current-voltage characteristic depending upon an environmental temperature, in a manner such that a higher temperature causes the element to have a lower emission threshold Vth, while a lower temperature causes it to have a higher emission threshold Vth. As a result, when driving at a constant voltage, an emission brightness thus obtained will undesirably change as L1, L2, and L3 depending on an environmental temperature. Consequently, as compared with an emission brightness set at a room temperature, a low temperature will cause a relative brightness to decrease and thus forms a dark state, while a high temperature will cause the relative brightness to increase and thus forms a bright state, hence rendering it impossible to maintain an acceptable displaying performance.

In order to solve the above problems, Japanese Unexamined Patent Application Publication Nos. 2001-223074 and 2002-304155 have suggested an improved technique for falsely realizing a constant-current driving by controlling a driving voltage while still maintaining a constant-voltage driving.

The above-mentioned technique can be explained with reference to FIG. 1B. Namely, a self-emission display apparatus has a self-emission element section J1 which is driven by a data line (anode) driving circuit J2 and a scanning line (cathode) driving circuit J3. The self-emission element section J1 includes a monitor element section JIB in addition to a display element section J1A. An electric current (monitor current) flowing through the monitor element section JIB is detected by a current detecting circuit J4, while a voltage adjusting circuit J6 is adjusted in accordance with an output from a correcting circuit J5 in a manner such that the monitor current will become equal to a predetermined current, thereby controlling a driving voltage applied to the data line driving circuit J2.

According to the prior art mentioned above, if a driving voltage of the display element section J1A is controlled in accordance with an operating state of the monitor element section JIB, it is possible to make constant a driving current of the display element section J1A which is driven by a constant voltage, without being affected by a temperature, thereby rendering a displaying performance not depending on an environmental temperature. Moreover, if a lighting rate of the monitor element section is adjusted so as to make a life characteristic of the monitor element section to be substantially equal to that of the display element section, it becomes possible to perform a control for increasing a driving voltage so as to avoid a brightness reduction to some extent, thereby making it possible to deal with a brightness reduction caused by an increased internal resistance (which is formed due to a long-term use).

However, a self-emission element such as an organic EL element has been known to have a degradation property generally shown in FIG. 2. That is, a brightness-current performance will become deteriorated with the development of the degradation shown in FIG. 2A, and a current-voltage performance will have the similar problem shown in FIG. 2B. On the other hand, it is possible to control a driving voltage of the display element section J1A according to an operating state of the monitor element section J1B so as to deal with a self-emission element showing the foregoing degradation as in the forgoing prior art, thereby effecting a control for increasing the driving voltage to deal with a decreased brightness. However, there is still a problem that the brightness will decrease with the passing of driving time due to a deterioration in the brightness-current performance.

Moreover, with regard to different materials exhibiting different emission colors, brightness reductions with the passing of driving time will have different velocities, as shown in FIG. 2C. For example, during a color displaying based on a mixed coloring involving a plurality of different colors, if driving voltages for effecting light emissions of various different colors are corrected in only one manner, a color balance set in advance will get collapsed due to different brightness reduction velocities with the passing of driving time, thus rendering it impossible to provide a desired color displaying. In particular, when a white color is displayed based on a mixed coloring involving R (red), G (green), and B (blue), there will be a distortion in color taste, resulting in a deteriorated picture displaying.

SUMMARY OF THE INVENTION

The present invention is to solve the aforementioned problem and makes this as one of its tasks. Namely, it is an object of the present invention to provide an improved self-emission apparatus capable of controlling a driving voltage of a display element section according to an operating state of a monitor element section. Another object of the invention is to provide an improved method of driving the self-emission apparatus. Therefore, when a color displaying is performed based on a mixed coloring involving a plurality of different colors, it is possible to inhibit a color balance collapse possibly caused due to deteriorated properties of respective self-emission elements.

In order to achieve the above objects, the self-emission apparatus and the driving method therefore according to the present invention are characterized by at least the following aspects.

In one aspect of the present invention, there is provided a self-emission display apparatus comprising: a display element section including self-emission elements of different colors; a monitor element section including self-emission elements of different colors formed in the same manner as the self-emission elements of the display element section; power supply means which supplies driving voltages for driving the self-emission elements of different colors to the display element section; monitor detecting means for detecting an operating state of the monitor element section; driving voltage control means for controlling the driving voltages in accordance with a detected operating state; display control means for supplying display signal to the display element section, further comprising: monitor control means for carrying out lighting controls of different colors on the monitor element section; and monitor load adjusting means for adjusting load states of different colors during the lighting control, thereby maintaining a color balance of the display element section.

In another aspect of the present invention, there is provided a method for driving a self-emission display apparatus which comprises: a display element section including self-emission elements of different colors; a monitor element section including self-emission elements of different colors formed in the same manner as the self-emission elements of the display element section; power supply means which supplies driving voltages for driving the self-emission elements of different colors to the display element section; monitor detecting means for detecting an operating state of the monitor element section; driving voltage control means for controlling the driving voltages in accordance with a detected operating state; and display control means for supplying display signal to the display element section. This method comprises a step of carrying out lighting controls of different colors on the monitor element section and adjusting load states of different colors during the lighting control so as to maintain a color balance of the display element section.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 3:
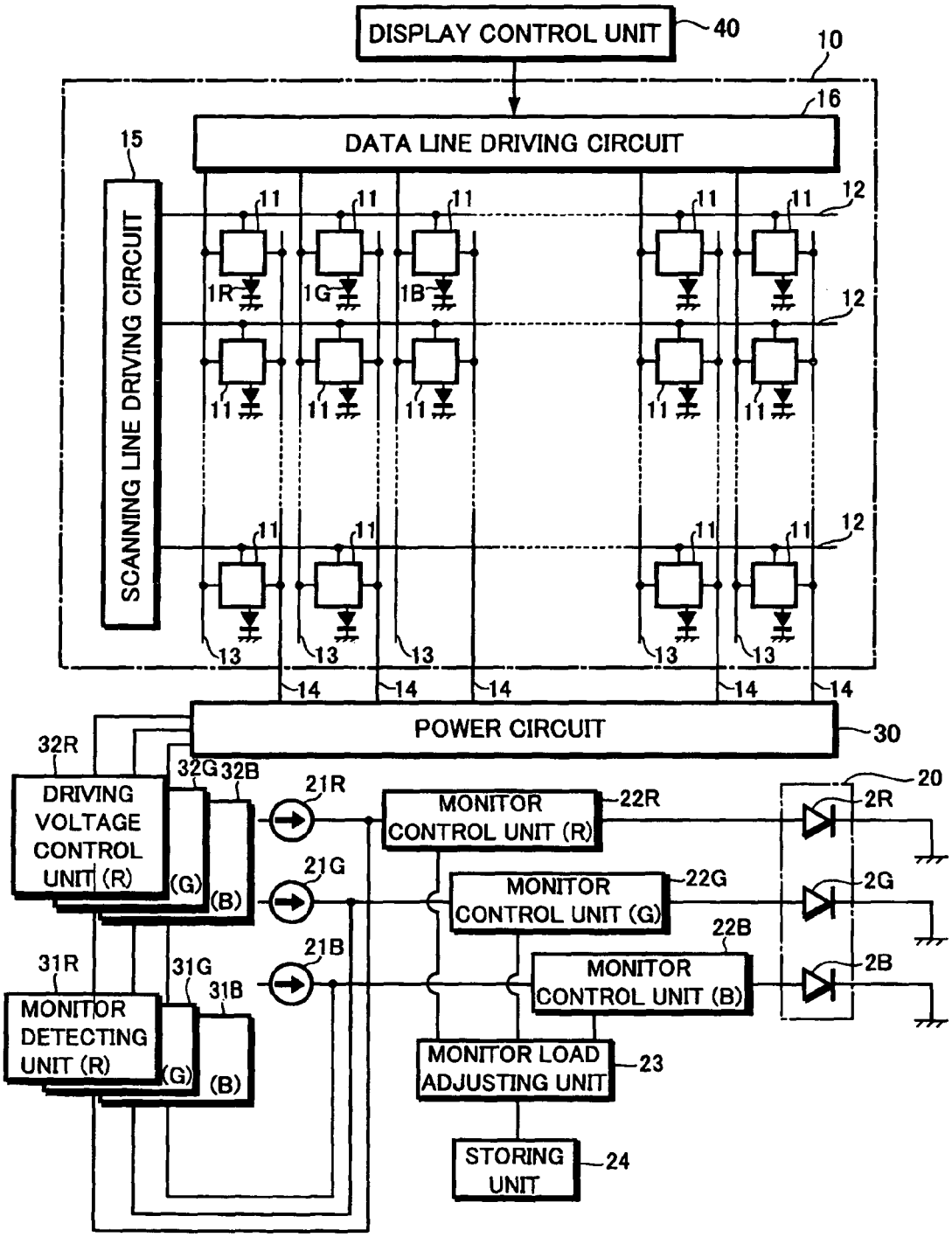
FIG. 3 is an explanatory diagram showing a self-emission display apparatus and its driving method according to an embodiment of the present invention.

In the following, description will be given to explain several embodiments of the present invention with reference to the accompanying drawings. FIG. 3 is an explanatory block diagram showing a self-emission display apparatus and a method of driving the same, according to one embodiment of the invention.

As shown, the self-emission display apparatus according to this embodiment of the present invention comprises: a display element section 10 including self-emission elements 1R, 1G, and 1B of different colors for carrying out a color displaying based on a mixed coloring involving a plurality of different colors; a monitor element section 20 including self-emission elements 2R, 2G, and 2B of different colors formed in the same manner as the self-emission elements 1R, 1G, and 1B and receiving supplies of constant currents from constant current sources 21R, 21G, and 21B; a power supply circuit 30 serving as voltage supply means which supplies different driving voltages for driving self-emission elements of different colors to the display element section 10; monitor detecting units (monitor detecting means) 31R, 31G and 31B for detecting an operating state of the monitor element section 20; driving voltage control units (driving voltage control means) 32R, 32G, and 32B which control driving voltages in accordance with a detected operating state; and a display control section (display control means) 40 for supplying a display signal to the display element section 10.

Here, although the description is given to explain an example which is a full color displaying based on three colors R, G, and B, the present invention is by no means to be limited to such a specific example. Actually, it is also possible to perform a color displaying based on a mixed coloring involving two or more different colors.

The display element section 10 can be further described as follows. Namely, element driving units 11 including control transistors and driving transistors based on TFT (Thin Film Transistors) are connected to self-emission elements 1R, 1G, and 1B, as well as to scanning lines 12, data lines 13, and power supply lines 14. The scanning lines 12 are connected to a scanning drive circuit 15, the data lines 13 are connected to a data line driving circuit 16, the power supply lines 14 are connected to a power circuit 30. Here, although the description is based on an example which is an active driving apparatus, this should not form any limitation to the embodiments of the present invention. In fact, the present invention can also include a passive driving.

Further, the self-emission display apparatus having the foregoing structure formed according to the present embodiment of the present invention has monitor control units (monitor control means) 22R, 22G, and 22B which perform lighting controls of the foregoing different colors on the monitor element section 20, as well as a monitor load adjusting unit (monitor load adjusting means) 23 which adjusts a load state of each of the foregoing different colors in each lighting control so as to maintain a color balance of the display element section 10.

Similar to the above-discussed prior art, the self-emission display apparatus of the present embodiment can operate in a manner such that its monitor detecting elements 31R, 31G, and 31B will detect changes in the current-voltage characteristics of the self-emission elements 2R, 2G and 2B driven by constant currents, by respectively detecting their driving current changes and driving voltage changes. Then, the driving voltage control units 32R, 32G, and 32B are operated in accordance with the detection results, so as to control the driving voltages of the self-emission elements 1R, 1G, and 1B of the display element section 10. In this way, it is possible to correct some undesired driving current changes caused due to temperature changes, by controlling the related driving voltages.

Figure 1A:
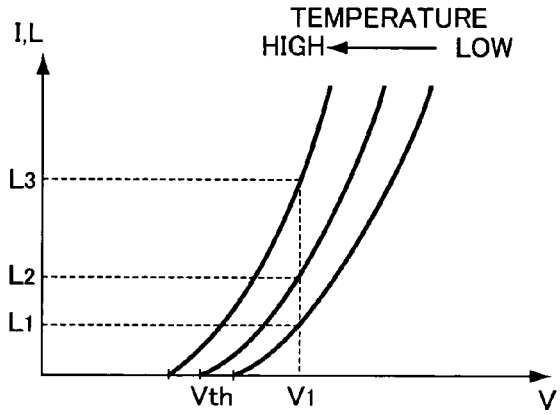
FIG.1 A PRIOR ART
FIG. 1A is a graph and FIG. 1B is an explanatory diagram, showing a prior art.
Figure 1B:
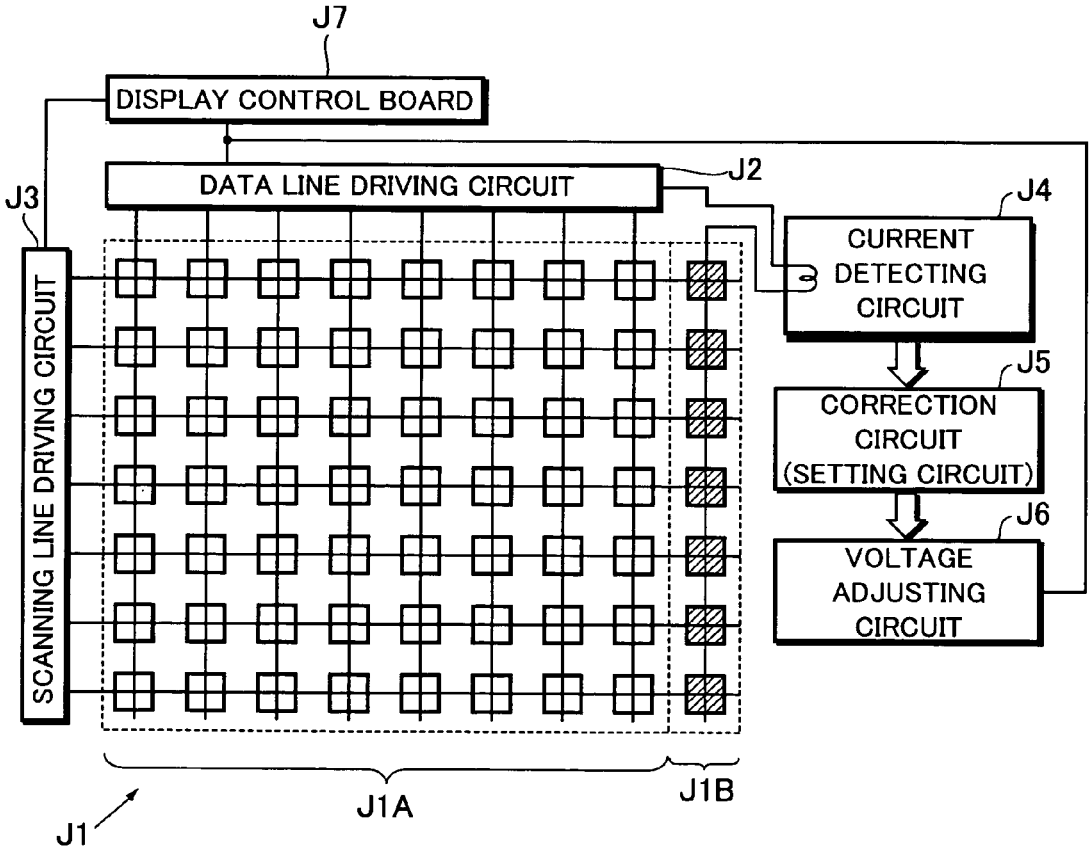
Figure 2A:
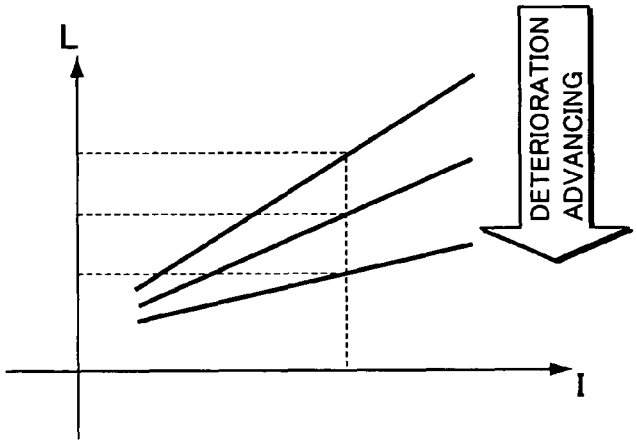
FIGS. 2A, 2B and 2C are graphs showing deterioration characteristics of self-emission elements.
Figure 2B:
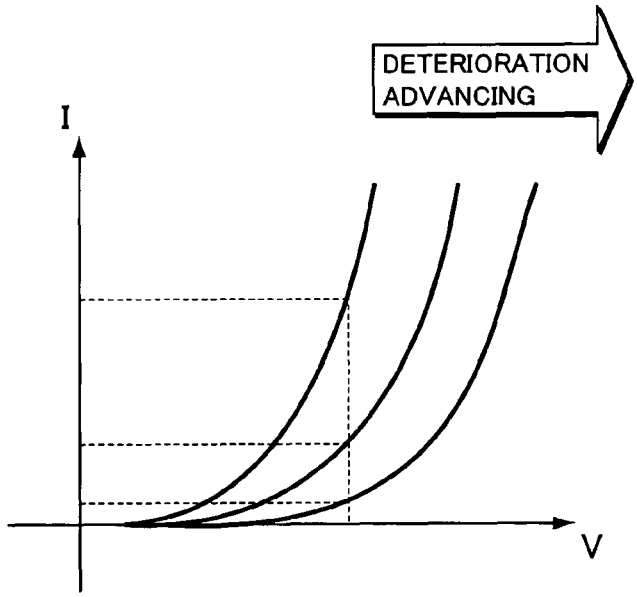
Figure 2C:
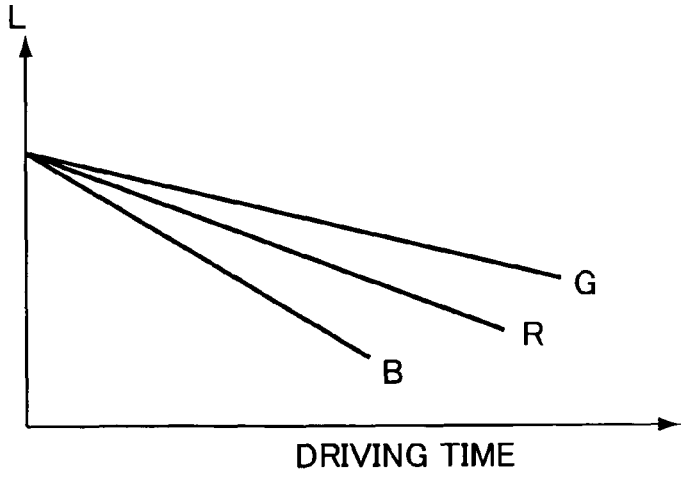

Usually, in the prior art, if there is a brightness decrease caused due to deteriorations of the self-emission elements 1R, 1G, and 1B, even if the operating states of self-emission elements 2R, 2G and 2B of the monitor element section 20 are detected and their driving voltages are increased, it is still impossible to avoid a brightness decrease occurring with the passing of driving time due to a deterioration in brightness-current characteristic. Moreover, if the driving voltages for driving the self-emission elements of different colors are controlled in only one manner, the deterioration velocities of self-emission elements of different colors will be different from one another as shown in FIG. 2C, thus destroying a desired color balance in color displaying on the display element section 10.

In order to avoid the above problem, the present embodiment of the present invention adjusts correction levels to different extents for different colors in controlling the driving voltages, thereby minimizing the collapse of color balance.

Namely, with respect to the monitor control units 22R, 22G, and 22B for performing a lighting control of each color on the monitor element section 20, the monitor load adjusting unit 23 adjusts a load state of each color during the lighting control, thereby making it possible to adjust at different extents the correction levels of driving voltages of different colors controlled by the driving voltage control units 32R, 32G, and 32B.

Figure 4:
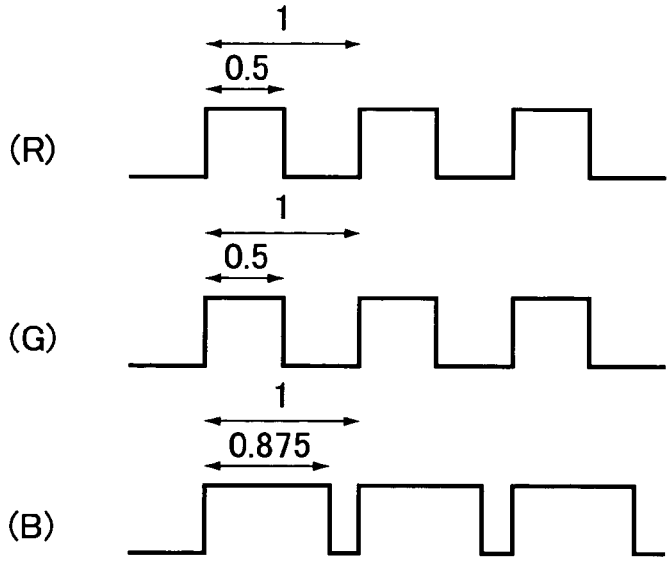
FIG. 4 is an explanatory chart showing an operation of a monitor load adjusting unit according to an embodiment of the present invention.

A more detailed example of the monitor load adjusting unit 23 can be described as follows. Namely, as shown in FIG. 2C, when the deterioration characteristics of the self-emission elements 1R, 1G, and 1B (or 2R, 2G, and 2B) are such that the deterioration velocity of color B becomes the maximum, a lighting rate of the self-emission elements of color B will be adjusted to be higher than that of other self-emission elements 2R and 2G. In other words, as shown in FIG. 4, if the lighting rates of self-emission elements 2R and 2G are each set at 50%, the lighting rate of self-emission elements 2B will be set at a higher level such as 87.5%.

Figure 5A:
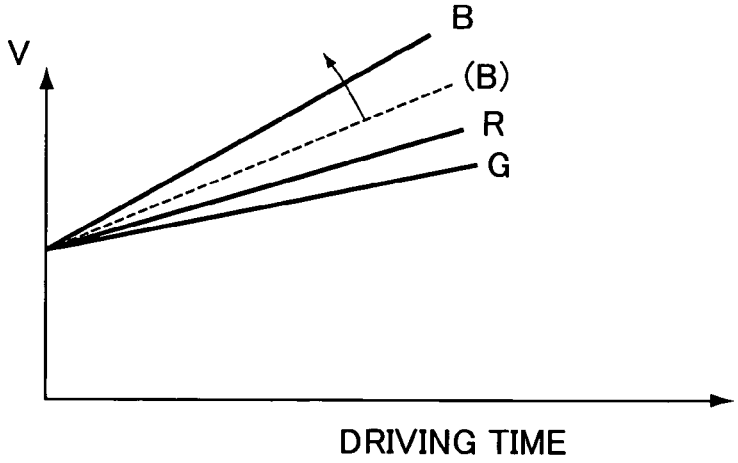
FIGS. 5A and 5B are graphs showing an operation of a self-emission display apparatus and its driving method according to an embodiment of the present invention.

In this way, the self-emission elements 2B having the maximum deterioration velocity will become deteriorated at a further higher velocity as compared with other self-emission elements 2R and 2G, while driving voltages are controlled in response to changes in operating states at this time. As a result, corrections performed on the self-emission elements 1B of the display element section 10 will become excessive. Namely, when the self-emission elements 2R, 2G, and 2B are lighting-controlled at the same level of lighting rate, a rising of a driving voltage with the passing of a driving time due to a deterioration will be corrected in a manner such that a higher deterioration velocity will have a higher rising rate, as shown in FIG. 5A. On the other hand, by making the lighting rate of the self-emission elements 2B higher than that of other self-emission elements of other colors, a rising rate of the driving voltages V of the self-emission elements 2B with the passing of driving time will be excessively corrected so as to be higher than a condition (dashed line) having the same level of a lighting rate.

Figure 5B:
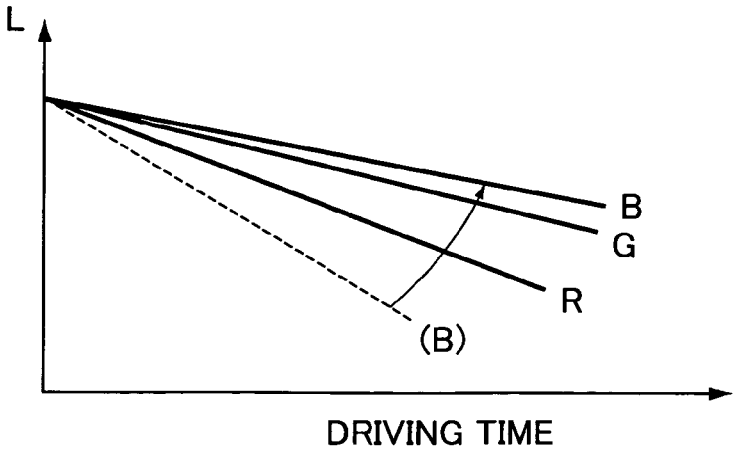

As a result, a brightness decrease of the self-emission elements 1B with the passing of driving time will receive a correction based on an excessive voltage rising larger than the corrections of the self-emission elements 1R and 1G of other colors, so as to be corrected to a deterioration velocity having the same level as the self-emission elements 1R and 1G, as shown in FIG. 5B. In this way, it is possible to maintain a color balance of a color displaying based on the display element section 10 at an acceptable degree, even if there is a brightness decrease caused by a deterioration of the self-emission elements 1R, 1G, and 1B.

Moreover, the monitor load adjusting unit 23 operates to cause the data relating to the deterioration characteristics of respective colors of the self-emission elements 1R, 1G, and 1B (or 2R, 2G, and 2B) to be stored in a memory unit 24, so as to perform an adjustment based on the stored data.

As a result, it is possible to properly adjust a load state in response to individual characteristics of the self-emission elements 1R, 1G, and 1B (or 2R, 2G, and 2B), thereby making it possible to maintain a color balance of a color displaying at an acceptable degree.

Figure 6:
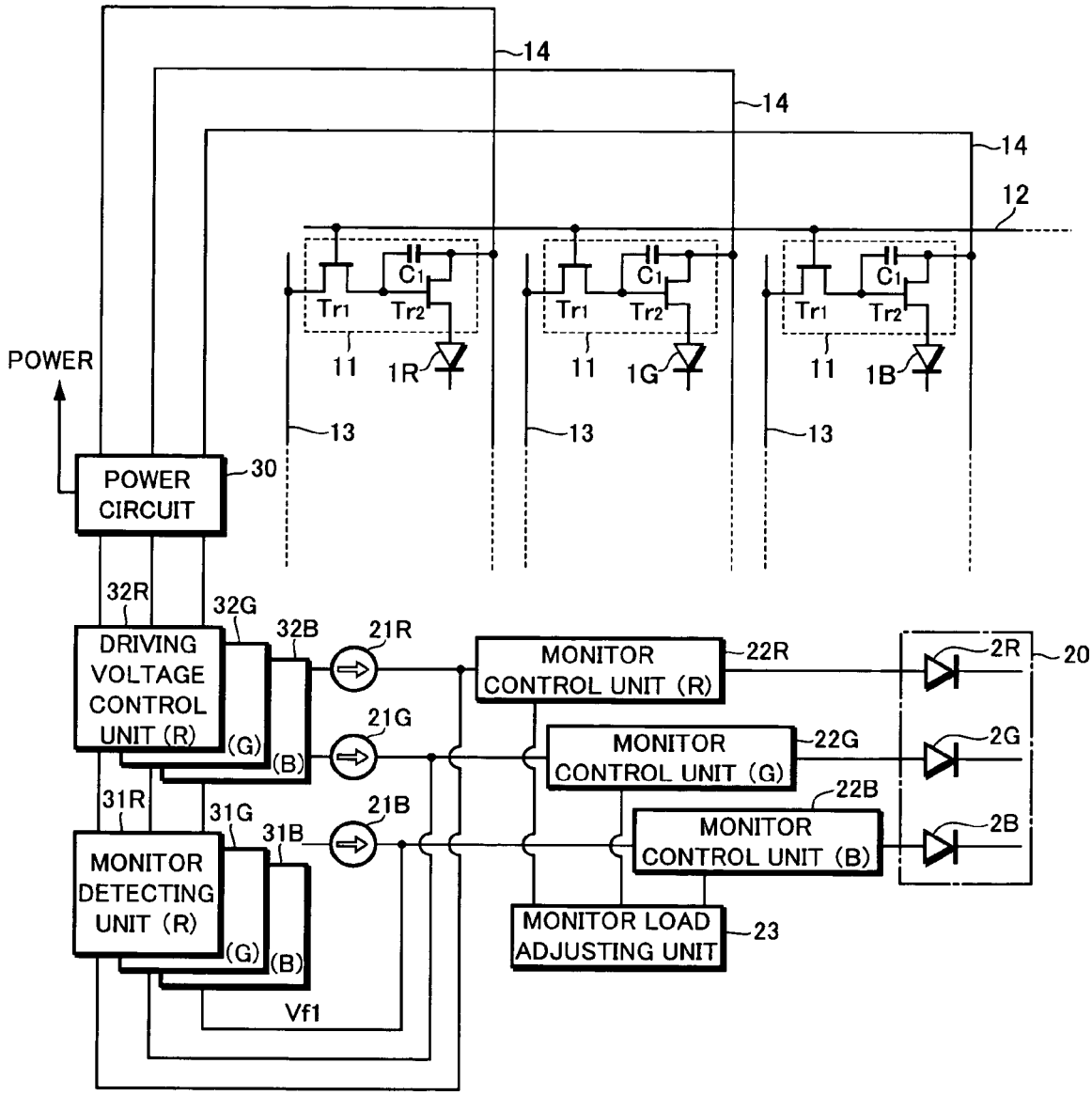
FIG. 6 is an explanatory diagram showing in detail the structure of a self-emission display apparatus formed according to an embodiment of the present invention.

FIG. 6 is an explanatory block diagram showing in more detail the structure of the aforementioned self-emission display apparatus. As shown, a plurality of display pixels including the self-emission elements 1R, 1G, and 1B are arranged in an array of matrix on the display panel of the self-emission display apparatus, while the monitor element section 20 forming a forward voltage monitor is disposed in one portion (an end portion) of the display panel.

Moreover, the data lines 13 through which data signals from the data-line driving circuit 16 are supplied are arranged in the longitudinal direction (column direction), while the scanning lines 12 through which scanning selection signals from the scanning-line driving circuit 15 are supplied are arranged in the horizontal direction (row direction). Further, power supply lines 14 are arranged in the longitudinal direction corresponding to the respective data lines on the display panel.

An element driving unit 11 for each display pixel has a structure based on the conductance control manner (as one example). Namely, the gate of each control transistor Tr1 formed by N-channel type TFT is connected to the scanning lines 12, and the source thereof is connected to the data lines 13. Further, the drain of each control transistor Tr1 is connected to the gate of a driving transistor Tr2 formed by P-channel type TFT, as well as to one terminal of an electric charge holding capacitor C1. The source of the driving transistor Tr2 is connected to the other terminal of the capacitor C1, as well as to the power supply lines 14. Moreover, the anode of each of the self-emission elements 1R, 1G, and 1B is connected to the drain of each driving transistor Tr2, while the cathode thereof is connected to a cathode side power line Vc.

In such pixel structure, once an ON-voltage is supplied from the scanning-line driving circuit 15 to the gate of each driving transistor Tr1 through a scanning line 12, the driving transistor Tr1 will be actuated to inject an electric current (corresponding to a data voltage supplied from a data line 13 to the source thereof) from its source to its drain. Therefore, during a period in which the gate of each driving transistor Tr1 is at ON-voltage, the foregoing capacitor C1 will be charged and its voltage will be supplied to the gate of each driving transistor Tr2.

Accordingly, each driving transistor Tr2 injects an electric current based on a gate voltage and a source voltage into each of the self-emission elements 1R, 1G, and 1B, thereby causing the self-emission elements 1R, 1G, and 1B to emit light. Namely, in the present embodiment, the driving transistors Tr2 formed by TFT operate in a saturated region, so as to drive the self-emission elements 1R, 1G, and 1B at a constant voltage.

Moreover, when the gate of a control transistor Tr1 is at OFF-voltage, such a transistor will be in cut-off state, and the drain of the control transistor Tr1 will be open. On the other hand, a control transistor Tr2 will hold its gate voltage by virtue of charges accumulated in the capacitor C1, and also hold the foregoing driving voltage until a next scanning, thereby sustaining the emissions of the self-emission elements 1R, 1G, and 1B.

On the other hand, the self-emission elements 2R, 2G, and 2B which are provided for use in monitoring and disposed in the monitor element section 20 are formed by using elements having the same electric property (i.e., identical specification) as the self-emission elements 1R, 1G, and 1B forming the foregoing display pixels. Namely, the self-emission elements 1R, 1G, and 1B forming the display pixels, and the self-emission elements 2R, 2G, and 2B forming the monitoring means can be formed simultaneously on the display panel in the same step of manufacturing process. However, when a driving current has been injected from the constant current sources 21R, 21G, and 21B into the monitoring self-emission elements 2R, 2G, and 2B, there will be a light emission. In view of this, it is preferable that the monitoring self-emission elements 2R, 2G and 2B be covered by light blocking masks (not shown) so as to block an emitted light.

A forward voltage Vf1 serving as a first information signal is taken out from the anode of each of the monitoring self-emission elements 2R, 2G and 2B (which together form a forward voltage monitoring section), and supplied to each of the monitor detecting units 31A, 31G, and 31B each equipped with an operational amplifier. The forward voltage Vf1 obtained by virtue of the monitor elements can be utilized as one corresponding to forward voltage of the self-emission elements 1R, 1G, and 1B arranged on the display panel for light emission. Namely, the forward voltage Vf1 obtained by virtue of the monitoring self-emission elements 2R, 2G and 2B can be used as a forward voltage depending on the same aging as the self-emission elements 1R, 1G, and 1B arranged on the display panel for light emission.

The monitor detecting units 31R, 31G, and 31B supply the above-mentioned information signals (forward voltages Vf1) to the driving voltage control units 32R, 32G, and 32B, so as to establish a control amount. The power supply circuit 30 serving as a power supply unit is formed by a DC-DC converter which increases a primary side voltage supplied from a power source so as to obtain a display panel driving voltage. The foregoing driving voltage control units 32R, 32G, and 32B will control a rising voltage level of the DC-DC converter, and output a voltage as a driving voltage which is applied to the self-emission elements 1R, 1G, and 1B.

Figure 7:
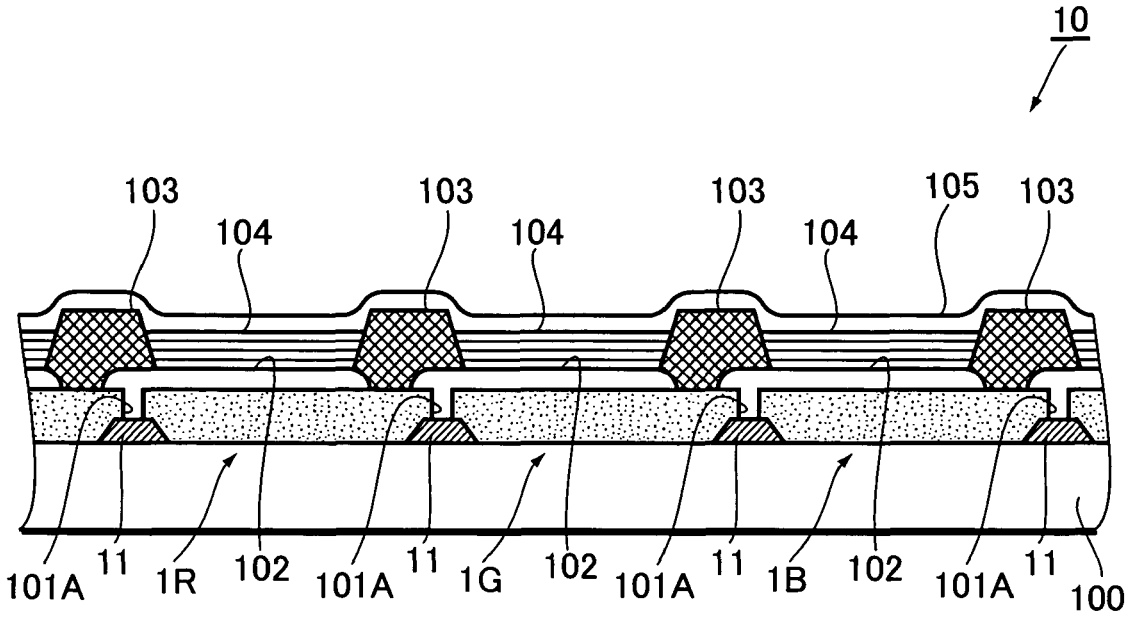
FIG. 7 is an explanatory view schematically showing a sectional structure of a display element section formed by organic EL elements.

In the following, description will be given to explain an example in which organic EL elements are used as the self-emission elements 1R, 1G, and 1B. FIG. 7 is an explanatory view schematically showing a cross sectional structure of the display element section 10 formed by organic EL elements. Here, the example shows the structure of active-driven organic EL elements (self-emission elements 1R, 1G, and 1B). As shown, the display element section 10 is formed in a manner such that a flattening film 101 having connecting holes 101A is formed to cover the element driving units 11 mounted on a substrate 100. Then, lower electrodes 102 are patterned on the flattening film in the position of each display element. Such lower electrodes 102 are connected to the element driving units 11 through the connecting holes 101A. Further, an insulating layer 103 is formed to divide the emission area above the lower electrodes 102 into several portions, and an organic EL functional film layer 104 is formed in the emission area divided by the insulating film 103, followed by forming thereon at least one upper electrode layer 105.

Each organic EL element comprises an anode (hole injection electrode) which is one of the lower electrode 102 and the upper electrode 105, and a cathode (electron injection electrode) which is the other of the lower electrode 102 and the upper electrode 105, with the organic EL functional layer 104 interposed between the two electrodes. When a voltage is applied to the two electrodes, positive holes injected and transported from the anode into the organic EL functional layer 104 will be combined in the functional layer (luminescent layer) with the electrons injected and transported from the cathode into the organic EL functional layer 104. Various components of the above-described self-emission element will be described as follows.

If a self-emission display panel is a bottom emission type which emits light from the substrate side, the substrate 100 will be formed by a plate-like or film-like glass or plastic material having a transparency. On the other hand, if the self-emission plate is a top emission type which emits light from one side opposite to the substrate side, the substrate 100 is not required to be transparent.

One of the lower electrode 102 and the upper electrode 105 is set to be a cathode, while the other thereof is set to be an anode. At this time, it is preferable to form an anode using a material having a high work function, such as a metal film which may be chromium (Cr), molybdenum (Mo), nickel (nickel), platinum (Pt) or the like, or a transparent conductive film based on a metal oxide such as ITO, IZO or the like. On the other hand, a cathode is preferred to be formed by a material having a low work function, which may be a metal, its compound and an alloy containing these substances, such as an alkali metal (Li, Na, K, Rb, Cs), an alkaline earth metal (Be, Mg, calcium, Sr, Ba), and a rare earth metal, each having a low work function. Moreover, when the lower electrode 102 and the upper electrode 105 are all formed by a transparent material, it is allowable to provide a reflective film on one electrode side opposite to the light emission side.

Moreover, a lead-out electrode extending from a lower electrode 102 or an upper electrode 105 is a wiring electrode for connecting the electrodes to the driving means in the display element section 10. Preferably, such a lead-out electrode is formed by a low resistant metallic material such as Ag, Cr, and Al or their alloys.

Generally, a lower electrode 102 and a lead-out electrode can be formed by vapor depositing or sputtering a film formation material (for forming the lower electrode 102 and the lead-out electrode) on a material layer which may be ITO, IZO or the like, and patterned by a method called photolithography or the like. In detail, a lower electrode 102 and a lead-out electrode (in particular, a lead-out electrode which is required to have a low resistance) can each have a two-layer structure formed by laminating a low resistant metal such as Ag, Ag alloy, Al, Cr or the like on a base layer such as ITO and IZO. Alternatively, they can have a three-layer structure formed by further laminating on the foregoing two-layer structure a high oxidation-resistant material such as Cu, Cr, and Ta, serving as a protection layer for protecting Ag.

Further, the insulating film 103 dividing the emission area into several small portions can be formed by coating a polyimide or a photosensitive resin through spin coating or sputtering, followed by a patterning step using a method which is photolithography or printing.

If a lower electrode 102 serves as an anode and an upper electrode 105 serves as a cathode, an organic EL layer 104 formed between the lower electrode 102 and the upper electrode 105 will be in a laminated structure including positive hole transporting layer/luminescent layer/electron transporting layer (if a lower electrode 102 serves as a cathode and an upper electrode 105 serves as an anode, a laminated structure will be in an inversed order of the foregoing structure). Here, each of the luminescent layer, the positive hole transporting layer and the electron transporting layer may have only one layer structure or a laminated multi-layer structure. Further, it is also possible to omit either or both of the positive hole transporting layer and the electron transporting layer, with a remaining layer being only the luminescent layer. Moreover, if necessary, it is allowed to insert an organic functional layer such as a positive hole injecting layer, an electron injecting layer, a positive hole barrier layer and an electron barrier layer into the organic layer 104.

A material for forming the organic layer 104 can be suitably selected according to an actual application of organic EL element. Examples will be given below but will not form any limitation to the present invention.

The positive hole transporting layer may be formed by any well-known compound, provided that it has a high positive hole movability. In more detail, it is possible to use an organic material which may be a porphyrin compound such as copper phthalocyanine, an aromatic tertiary amine such as 4'4-bis[N-(1-naphthyl)-N-phenylamino]-biphenyl (NPB), a stilbene compound such as 4-(di-p-tolylamino)-4'-[4-(di-p-tolylamino) styryl]stilbenzene, a triazole derivative and a styrylamine compound. Moreover, it is also possible to use a high molecular material formed by dispersing, in a high molecular material such as a polycarbonate material, a low molecular organic material for transporting positive holes. Preferably, such a material has a glass transition temperature which is higher than a temperature for heating and hardening a sealing resin, for example, bis[N-(1-naphthyl)-N-phenylamino]-biphenyl (NPB).

The luminescent layer may be formed by any known luminescent material. In more detail, it is possible to use an aromatic dimethyldene compound such as 4,4'-bis(2,2'-diphenyl vinyl)-biphenyl (DPVBi), a styryl benzene compound such as 1,4-bis(2-methyl styryl)benzene, a triazole derivative such as 3-(4-biphenyl)-4-phenyl-5-t-butylphenyls-1,2,4-triazole (TAZ), an anthraquinone derivative, a luminescent organic material such as a fluorenone derivative, a luminescent organic metal compound such as (8-hydroxy quinolynate) aluminum complex ($Alq_3$), a high molecular material such as a polypara phenylenevinylene (PPV) system, a polyfluorene system, and a polyvinyl carbazole (PVK) system or the like, an organic material capable of making use of a phosphorescence from triplet excitons such as a platinum complex and an iridium complex (Japanese Patent Application Publication No. 2001-520450). In fact, it is possible for the luminescent layer to be formed either by a luminescent material only, or also contain a positive hole transporting material, an electron transporting material, an additive (a donor, an acceptor or the like) or a luminescent dopant. On the other hand, it is also possible for such a material to be dispersed in a high molecular material or in an inorganic material.

An electron transporting layer can be formed by any known compound, provided that it has a function of transporting the electrons injected from the cathode to the luminescent layer. In more detail, it is allowed to use an organic material such as a nitro-substituted fluorenone derivative and an anthraquinodimethan derivative, a metal complex of 8-quinolinol derivative, a metal phthalocyanine or the like.

If necessary, it is also allowable to insert an electron injection layer including a material such as lithium fluoride and lithium oxide between the electron transporting layer and the upper electrode. Besides, in order to inhibit a possible damage to the luminescence functional layer at the time of forming an upper electrode film, it is allowed to provide a protection layer including a material such as an alkaline earth metal and an alkaline earth metal oxide.

The above-mentioned hole transporting layer, luminescent layer, and electron transporting layer can be formed in a wet process which may be a coating such as spin coating and dipping, or a printing such as ink-jet and screen printing, or a dry process such as a vapor deposition and a laser transferring which will be discussed later.

If the self-emission elements 1R, 1G, 1B consisting of organic EL elements are provided to realize a color displaying involving light emissions of several colors, it is possible to use: a discriminative painting method which forms luminescent layers of two or more colors, including a method of forming three kinds of luminescent layers corresponding to colors RGB; a method in which a single color (white or blue) luminescence functional layer is combined with a color conversion layer formed by a color filter or a fluorescent material (CF manner, CCM manner); a photo breeching method which realizes a multiple light emission by emitting an electromagnetic wave or the like to the light emission area of a single color luminescent functional layer; and a laser transfer method in which several kinds of low molecular materials of different luminescent colors are formed in advance into different films and then transferred on to one substrate by means of thermal-transfer using a laser.

Although the embodiments of the present invention are particularly effective in forming an active type organic EL display apparatus based on digital time gradation drive, they are also suitable for use in forming an active type organic E1 display apparatus and a passive type organic EL display apparatus based on analog gradation drive.

According to the above-described self-emission display apparatus and its driving method of the present invention, it is possible to control a driving voltage of the display element section in accordance with an operating state of the monitor element section. Therefore, when performing a color displaying by virtue of several different colors, it is possible to inhibit a collapse of a color balance possibly caused due to deterioration of self-emission elements.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A self-emission display apparatus comprising:

a display element section including self-emission elements of different colors, wherein the self-emission elements have different brightness reduction velocities according to color and are made of different materials;

a monitor element section including self-emission elements of different colors formed in the same manner as the self-emission elements of the display element section;

power supply means which supplies driving voltages for driving the self-emission elements of different colors to the display element section;

monitor detecting means for detecting an operating state of the monitor element section;

driving voltage control means for controlling the driving voltages in accordance with a detected operating state;

display control means for supplying display signal to the display element section, further comprising:

monitor control means for carrying out lighting controls of different colors on the monitor element section; and monitor load adjusting means for adjusting load states of different colors during the lighting control, thereby maintaining a color balance of the display element section;

wherein the monitor load adjusting means adjusts the load states of the self-emission elements of one color in the display element section to have a higher brightness reduction velocity due to deterioration than the self-emission elements of other colors in the monitor element section by making a lighting rate of the self-emission elements of the one color higher than a lighting rate of the self-emission elements of the other colors; and wherein a brightness reduction of the self-emission elements of the one color in the display element section receives an excessive correction based on an excessive voltage rising larger than correction voltage values of the self-emission elements of the other colors, so as to be corrected to a same level of brightness reduction velocity as the self-emission elements of the other colors.

2. The self-emission display apparatus according to claim 1, wherein the monitor load adjusting means is adjusted in accordance with stored data relating to deterioration characteristics of self-emission elements of different colors.

3. A method for driving a self-emission display apparatus, said apparatus comprising:

a display element section including self-emission elements of different colors wherein the self-emission elements have different brightness reduction velocities according to color and are made of different materials;

a monitor element section including self-emission elements of different colors formed in the same manner as the self-emission elements of the display element section;

power supply means which supplies driving voltages for driving the self-emission elements of different colors to the display element section;

monitor detecting means for detecting an operating state of the monitor element section;

driving voltage control means for controlling the driving voltages in accordance with a detected operating state;

display control means for supplying display signal to the display element section, wherein said method comprises a step of:

carrying out lighting controls of different colors on the monitor element section and adjusting load states of different colors during the lighting control so as to maintain a color balance of the display element section;

wherein the load state adjustment is performed on the self-emission elements of one color in the display element section to have a higher brightness reduction velocity due to deterioration than the self-emission elements of other colors in the monitor element section by making a lighting rate of the self-emission elements of the one color higher than a lighting rate of the self-emission elements of the other colors; and wherein a brightness reduction of the self-emission elements of the one color in the display element section is received based on an excessive voltage rising larger than correction voltage values of the self-emission elements of the other colors, so as to be corrected to a same level of brightness reduction velocity as the self-emission elements of the other colors.

* * * * *